US007014227B2

(12) United States Patent
Strangward et al.

(10) Patent No.: US 7,014,227 B2
(45) Date of Patent: Mar. 21, 2006

(54) WEDGE BAR LOCKING MECHANISM

(75) Inventors: William C. Strangward, Rocky River, OH (US); Ion Moldovan, Cleveland, OH (US)

(73) Assignee: The Langenau Manufacturing Company, Cleveland, OH (US)

( * ) Notice: Subject to any disclaimer, the term of this patent is extended or adjusted under 35 U.S.C. 154(b) by 99 days.

(21) Appl. No.: 10/840,874

(22) Filed: May 7, 2004

(65) Prior Publication Data

US 2004/0222644 A1 Nov. 11, 2004

Related U.S. Application Data

(60) Provisional application No. 60/469,104, filed on May 9, 2003.

(51) Int. Cl.
*E05C 1/12* (2006.01)

(52) U.S. Cl. ..... 292/160; 292/39; 292/142; 292/145; 292/155; 292/156; 292/162; 292/251; 292/301; 70/140; 27/DIG. 1

(58) Field of Classification Search ..... 292/160, 292/32, 39, 137, 142, 145, 156, 157, 161, 292/155, 162, 251; 70/140, 403; 27/DIG. 1; 403/323

See application file for complete search history.

(56) References Cited

U.S. PATENT DOCUMENTS 1,438,547 A * 12/1922 O'Connor ..... 292/161
2,284,921 A * 6/1942 Purkiss ..... 27/17
2,323,674 A * 7/1943 Purkiss ..... 292/157
2,417,756 A * 3/1947 Hillenbrand ..... 292/157
2,723,147 A * 11/1955 Slaughter, Jr. et al. ..... 292/302
2,821,770 A * 2/1958 Gruber ..... 27/17
2,830,355 A * 4/1958 Christian ..... 27/17
2,864,640 A * 12/1958 Mattinson ..... 292/335
3,439,465 A * 4/1969 Du Pre ..... 52/584.1
3,478,919 A * 11/1969 Turpen ..... 220/324
3,944,267 A * 3/1976 Sundquist ..... 292/158
3,981,054 A * 9/1976 Hull et al. ..... 27/17
4,486,040 A 12/1984 Strangward
4,699,409 A * 10/1987 Newman ..... 292/357
5,219,191 A * 6/1993 Wolter ..... 292/157
5,265,923 A * 11/1993 Paddock ..... 292/336.3
5,457,861 A * 10/1995 Lloyd ..... 27/10
5,503,439 A 4/1996 LaJeunesse et al.
6,154,938 A 12/2000 LaJeunesse et al.
6,651,389 B1 * 11/2003 Minter et al. ..... 49/394

FOREIGN PATENT DOCUMENTS

GB WO 9012942 * 11/1990
GB 2260362 * 4/1993
GB 2277958 * 11/1994

* cited by examiner

*Primary Examiner*—Brain E. Glessner
*Assistant Examiner*—Carlos Lugo
(74) *Attorney, Agent, or Firm*—Pearne & Gordon LLP

(57) ABSTRACT

A wedge bar locking mechanism is provided including a locking pin, a bracket and a wedge bar. In operation, the locking pin and wedge bar are mechanically coupled such that rotation of the locking pin results in translational motion of the wedge bar. The wedge bar and locking pin are received in the bracket which prevents rotational motion of the wedge bar and translational motion of the locking pin. In a preferred embodiment, the bracket has retaining tabs permanently attached or integral thereto, and extending radially inward of a longitudinal cylindrical pathway for accommodating the locking pin therein. The tabs are received within a reduced diameter portion of the locking pin to prevent translation thereof.

18 Claims, 3 Drawing Sheets

WEDGE BAR LOCKING MECHANISM

This application claims the benefit of U.S. Provisional Patent Application Ser. No. 60/469,104 filed May 9, 2003.

BACKGROUND OF THE INVENTION

The invention relates to a locking mechanism. More particularly, it relates to a wedge bar locking mechanism for a casket that has only three principal components.

Wedge bar locking mechanisms are generally known in the art, and are described for example in U.S. Pat. No. 5,503,439 which is incorporated herein by reference. In a conventional wedge bar locking mechanism, as described in the '439 patent, a wedge bar is threaded at one end to a screw so that as the screw is turned, the wedge bar is caused to move longitudinally so that a series of catches spaced along the length of the wedge bar engage a series of corresponding escutcheons or rollers to pull the lid of the casket tightly closed. In this conventional mechanism, the discrete parts include a wedge bar, a screw, a bracket, and a bronze clip. The bracket is necessary to prevent rotation of the wedge bar, and the clip retains the screw in place in the bracket in order to prevent longitudinal movement of the screw.

While the above-described mechanism has been successful, it suffers from a number of drawbacks. First, both the wedge bar and the bracket require numerous stamping and bending operations in order to provide their complex shapes. Second, the bronze clip must be assembled to the bracket after the screw is inserted into the bracket. Being a separate piece, the clip can come out which may result in failure of the mechanism by permitting longitudinal translation of the screw. Third, the bracket has many complex bends which must conform to particular dimensions, and the slot to accommodate the screw and the bronze clip also must be precisely formed and dimensioned. Fourth, the assembly includes four separate components that must be separately made, contributing to the overall complexity and cost.

There is a need in the art for a wedge bar locking mechanism for a casket where the means for securing the screw in position in the bracket are not prone to detachment from the bracket, thus eliminating a key failure mode of the mechanism. Preferably, such an improved mechanism has fewer than four separate components, and will be simple and relatively inexpensive to manufacture.

SUMMARY OF THE INVENTION

A wedge bar locking mechanism is provided having a locking pin, a wedge bar and a bracket. The locking pin includes a reduced diameter portion and a threaded portion, wherein the threaded portion has a continuous helical groove disposed circumferentially about and extending longitudinally of the threaded portion. The wedge bar includes first and second longitudinally extending portions at a proximal end thereof, wherein the first and second longitudinally extending portions define a locking pin receiving space therebetween. At least one of the first and second longitudinally extending portions has at least one tooth extending into the pin receiving space defined between the first and second longitudinally extending portions. The tooth is dimensioned to extend into and be accommodated within the helical groove when the threaded portion is received in the pin receiving space. The bracket defines has a longitudinally extending slot to accommodate the wedge bar therein, and a longitudinally extending cylindrical portion defining a longitudinal cylindrical pathway adapted to accommodate the locking pin therein. The slot is effective to prevent the wedge bar from rotating as a result of torque supplied to the locking pin when the locking pin and the wedge bar are received, respectively, in the longitudinally cylindrical pathway and the slot.

A further wedge bar locking mechanism is provided, having a locking pin, a wedge bar and a bracket. The locking pin has a reduced diameter portion and a threaded portion, wherein the threaded portion has a continuous helical groove disposed circumferentially about and extending longitudinally of the threaded portion. The wedge bar has a longitudinally extending portion at a proximal end thereof, the longitudinally extending portion having at least one tooth dimensioned to extend into and be accommodated within the helical groove disposed in the threaded portion of the locking pin. The bracket defines a longitudinally extending slot adapted to accommodate the wedge bar therein, and a longitudinally extending cylindrical portion defining a longitudinal cylindrical pathway adapted to accommodate the locking pin therein.

DETAILED DESCRIPTION OF THE PREFERRED EMBODIMENTS OF THE INVENTION

Figure 1:
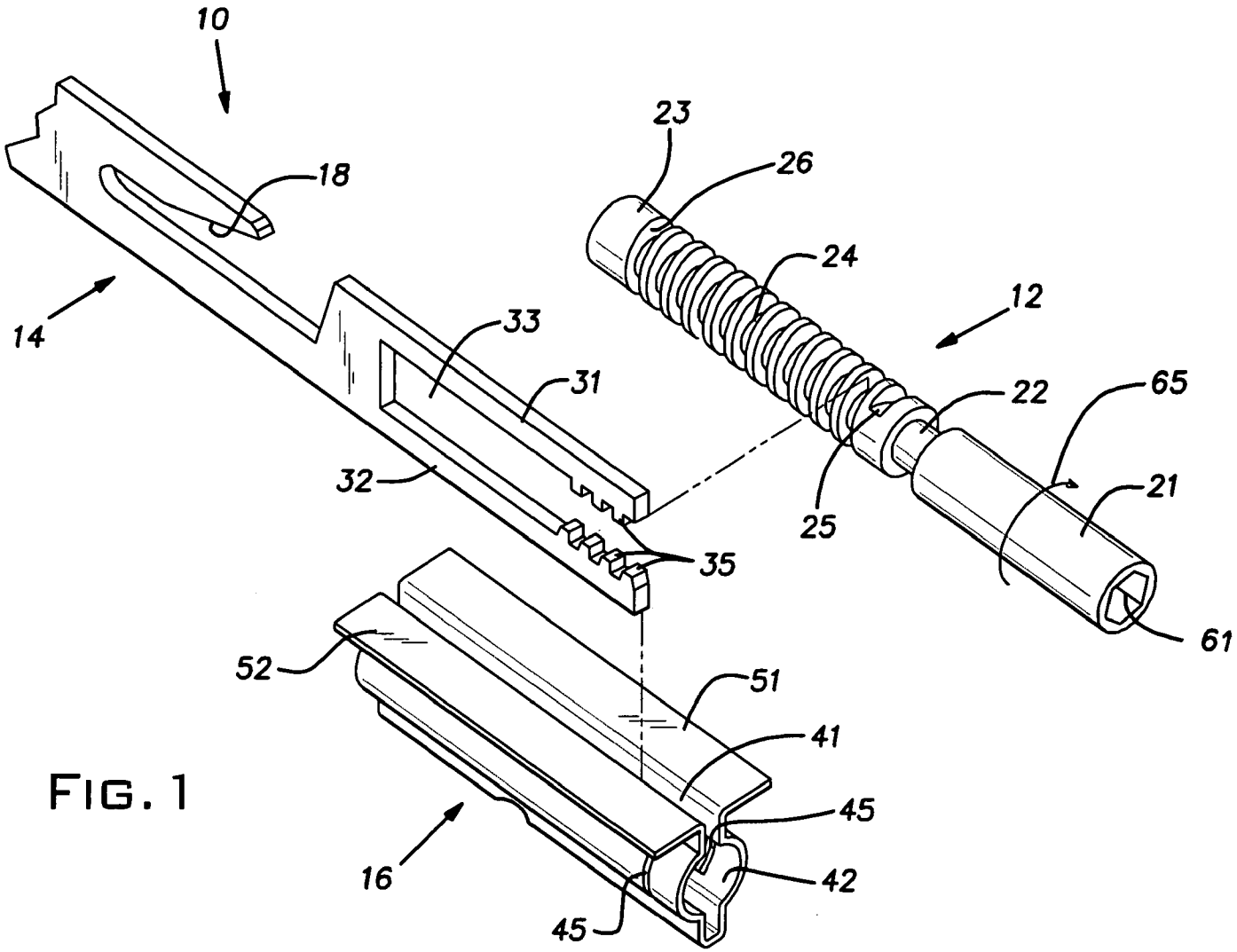
FIG. 1 shows a wedge bar locking mechanism according to the invention prior to assembly.
Figure 3:
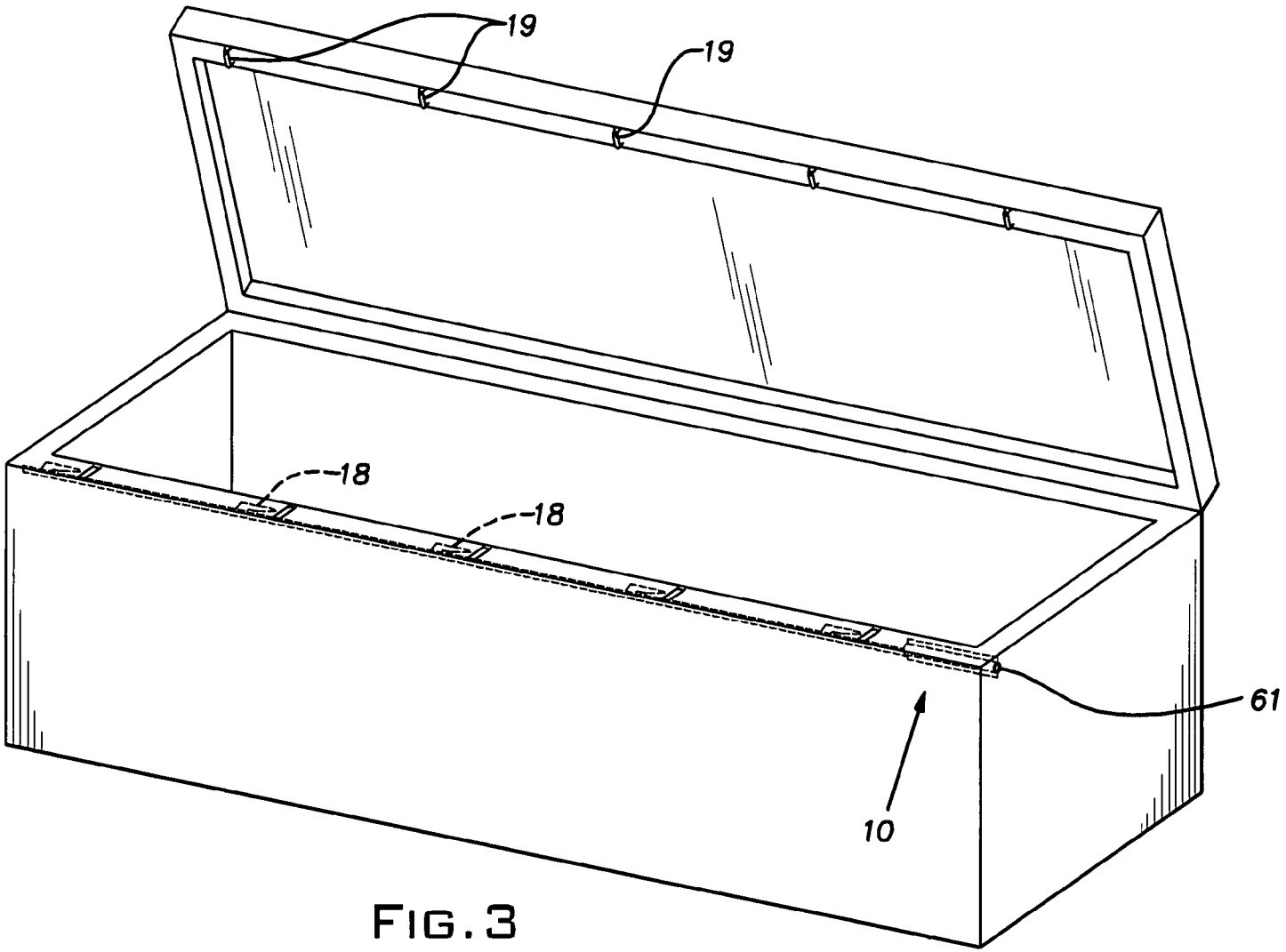
FIG. 3 shows a casket equipped with a wedge bar locking mechanism according to the invention.

Referring to FIG. 1, a preferred embodiment of the wedge bar locking mechanism 10 according to the invention is shown. It includes a locking pin 12, a wedge bar 14 and a bracket 16. Only the proximal end of the wedge bar 14 is shown (i.e., the end which engages the locking pin 12). A series of cammed catches 18 are provided along the length of the wedge bar 14, which are adapted to engage a series of corresponding escutcheons or rollers 19 (see FIG. 3) provided on the lid of a casket. In operation, the catches 18 draw the rollers 19, and correspondingly the casket lid, closer to the casket base until the lid is sealed shut as the catches 18 (wedge bar 14) are translated in the proximal direction as will be understood by a person of ordinary skill in the art. The function of the catches 18 and rollers 19 to seal a casket are well known in the art, and will not be further described here. Instead of rollers as illustrated in the drawings, the means (escutcheons) provided in the casket lid for engaging the catches 18 can be of any conventional design so long as, when the lid is closed, the action of the catches 18 in translating the wedge bar 14 in the proximal direction results in engaging and drawing such means toward the casket base ultimately to seal the casket lid as known in the art.

As can be seen in FIG. 1, the locking pin 12 (preferably made from metal) includes a head portion 21, a threaded portion 23 and an intermediate reduced diameter portion 22, and preferably is substantially round or cylindrical for reasons which will become apparent. Preferably, the head portion 21 is provided with a means for engagement by a tool or by hand so that the locking pin 12 can be turned, e.g. by a funeral director. Preferably, the engagement means is an Allen key receptacle 61 provided in the head portion by conventional means, adapted to mate with a corresponding Allen key for turning the locking pin 12. Alternatively, the engagement means can be any other conventional or suitable structure adapted to be engaged by a corresponding tool (or by hand) for turning the locking pin. For example, the engagement means can be a standard screw head (e.g., Phillips, flathead, hex, etc.) adapted to mate with a conventional screw driver, it can be a nut or bolt head adapted to mate with a wrench, or it can be a keyway or key receptacle adapted to mate with a correspondingly shaped key. Still further, the engagement means can be a wingnut or other structure adapted to be turned by hand. The exact structure of the engagement means is not critical to the invention, so long as it is adapted to facilitate turning the locking pin 12 in order to translate the wedge bar 14 (described in detail below) so the cammed catches 18 engage and lock down the corresponding escutcheons or rollers 19 to seal the casket in a conventional manner.

The reduced diameter portion 22 is preferably provided via machining, for example using a lathe as is known in the art. The threaded portion 23 is preferably provided in the form of an Acme threaded rod, most preferably a #5 Acme threaded rod. The threads can be provided, for example, by turning on a metalworking lathe to provide a continuous helical groove 24 along the length of the threaded portion 23. The helical groove 24 is provided circumferentially about the outer surface of the threaded portion 23, and extending longitudinally along the length of the threaded portion. Alternatively, and less preferably, conventional screw threads can be used for the threaded portion 23. Acme threads are more preferred generally because they are larger threads (i.e. they have a lower thread pitch in terms of number of threads per inch) and they have a deeper groove which is highly suited for interlocking with appropriately dimensioned teeth 35 to effect longitudinal translation of the wedge bar 14 as explained below. This facilitates faster, more convenient and more reliable and repeatable locking of a casket because fewer turns are required, and because the teeth 35 will be securely retained in the groove 24 as the locking pin 12 is turned.

Alternatively, the locking pin 12 can be made from a plastic material having physical properties sufficient to withstand the mechanical and torsional stresses to which it will be subjected during use. In this embodiment, preferably the locking pin 12 is made, e.g. molded, via conventional techniques from a high strength ABS plastic or equivalent material, or other plastic material having comparable or superior physical strength.

Whether the locking pin 12 is made from metal or plastic, the helical groove 24 for the preferred embodiment extends longitudinally along the length of the threaded portion 23, but does not continue all the way to the ends. The helical groove terminates at hard stops located at either end of the threaded portion 23, respectively a proximal hard stop 25 located adjacent the reduced diameter portion 22, and a distal hard stop 26 located adjacent the distal end of the locking pin 12. The purpose of these hard stops will become evident below.

The wedge bar 14 is provided at its proximal end with a first longitudinally extending portion 31 and a second longitudinally extending cantilevered portion 32. The two portions 31 and 32 are cantilevered from the proximal end of the wedge bar 14, and define a locking pin receiving space 33 between them. The receiving space 33 is dimensional to accommodate the outer diameter of the threaded portion 23 of the locking pin 12. The first and second longitudinally extending cantilevered portions 31 and 32 are provided with a plurality of spaced teeth 35 extending generally into the receiving space 33. The spacing of the teeth 35 corresponds with pitch of the threads, preferably helical groove 24, of the threaded portion 23, and the teeth 35 are dimensioned to extend into and be securely accommodated within the helical groove 24 when the threaded portion 23 of the locking pin 12 is received in the receiving space 33. Optionally, only one of the extending portions 31 and 32 need be provided with teeth 35 as will be apparent below.

Figure 2:
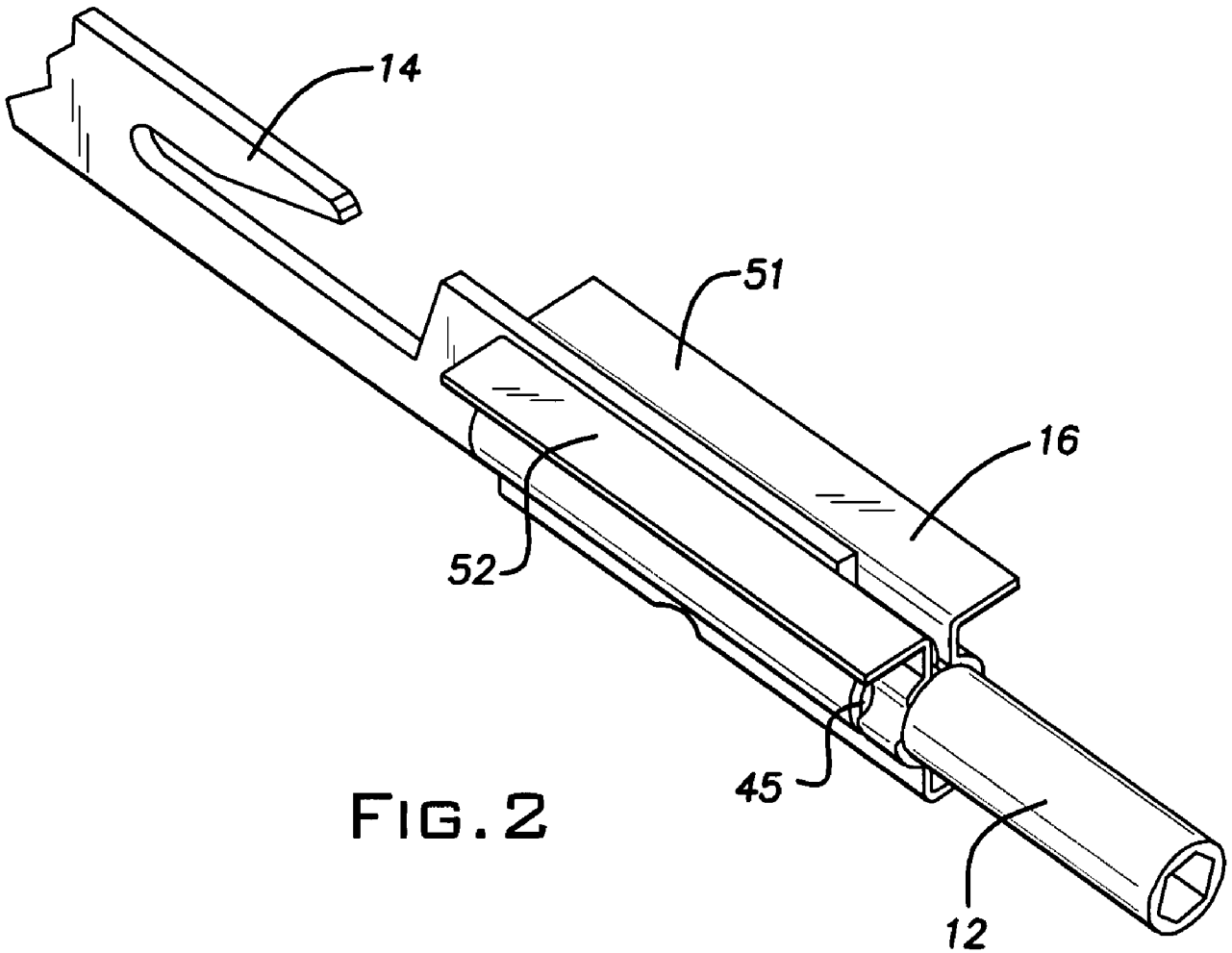
FIG. 2 shows the locking mechanism of FIG. 1 in an assembled condition.

Referring to FIGS. 1–2 and based on the above-described structure, it should be evident that when the mechanism is assembled (shown in FIG. 2), by rotating the locking pin 12 with the teeth 35 engaged within the groove 24 (threaded portion 23 received in the receiving space 33), the wedge bar 14 will be caused to move longitudinally (translate) with respect to the locking pin 12 as a result of the teeth 35 being engaged within the groove 24 as the pin is rotated. In the illustrated embodiment, rotating the locking pin 12 clockwise (arrow 65) will result in the wedge bar 14 being moved longitudinally in a proximal direction (i.e. toward the head portion 21) until the wedge bar 14 is prevented from advancing further due to one of the teeth 35 reaching the proximal hard stop 25. That is, proximal advancement of the wedge bar 14 and further rotation of the locking pin 12 in the clockwise direction are prevented once one of the teeth 35 reaches the end of the helical groove (proximal hard stop 25). A similar hard stop is provided at the distal end of the threaded portion 23 to prevent distal advancement of the wedge bar 14 relative to the locking pin 12 beyond a certain point. In this manner, the range of longitudinal motion or translation of the wedge bar 14 relative to the locking pin 12 is fixed by the longitudinal distance between the proximal and distal hard stops 25 and 26 in the threaded portion 23. The distance between the hard stops is set to correspond to the travel of the wedge bar 14 required in order to lock and unlock the mechanism (to lock and unlock the casket) via the catches 18 and corresponding rollers 19 as described and referred to above.

In order for the locking pin 12 and wedge bar 14 to function as described in the preceding paragraph, the pin must be prevented from longitudinal motion or translation and the wedge bar must be prevented from rotational or angular motion. These functions are performed by the bracket 16 is will now be described. The bracket 16 is provided via conventional bending techniques, and is made from a single piece or sheet of metal. The bracket 16 is bent such that it defines a longitudinally extending vertical slot 41 to accommodate and permit translation, but not rotation, of the wedge bar 14 therein. Provided substantially centrally relative to the vertical extent of the slot 41 is a cylindrical portion 42 also extending longitudinally of the bracket 16, and defining a longitudinal cylindrical pathway adapted to accommodate the outer diameter of the locking pin 12.

Preferably, the threaded portion 23 and head portion 21 of the locking pin 12 are of the same or substantially the same diameter, so that each is accommodated abuttingly (though with minimal friction) within the cylindrical portion 42 of the bracket 16 having a substantially constant inner diameter. At least one, preferably a plurality (most preferably a pair) of retaining tabs 45 are provided extending radially inward from the interior surface of the cylindrical portion 42 into the cylindrical pathway at a location corresponding to the position of the reduced diameter portion 22 of the locking pin 12 when it is assembled in the cylindrical pathway of the bracket 16. In the illustrated preferred embodiment, tabs 45 are provided by punching through the bracket 16 wall in the cylindrical portion 42 thereof such that the punched portion of the wall material extends or is cantilevered radially inward of the cylindrical portion 42, still attached to the bracket wall, to provide the tabs 45. This method is preferred because it provides tabs 45 that are integral to the bracket 16, obviating the need for additional or separate tab components to be attached to the bracket 16. Punched tabs 45 can be provided via conventional techniques using a punch once the cylindrical portion 42 of the bracket 16 has been formed, e.g. via bending around a cylindrical template or dowel of suitable diameter. Less preferably, the tabs 45 can be provided as separate components fixed (e.g. brazed or welded) to the inner surface of the cylindrical portion 42 and extending radially inward of the longitudinal cylindrical pathway.

In operation, the locking pin 12 is received within the longitudinal cylindrical pathway defined by the cylindrical portion 42 of the bracket 16, and positioned such that the radially inwardly extending tabs 45 are received and accommodated within the reduced diameter portion 22 of the locking pin 12. The tabs 45 prevent the locking pin 12 from translating longitudinally as the pin is turned, and the vertical slot 41 prevents the wedge bar 14 from rotating as a result of torque supplied to the locking pin 12. In this manner, when the locking mechanism 10 is fully assembled as described herein, rotation of the locking pin results in longitudinal motion or translation of the wedge bar 14 via the cooperating teeth 35 and groove 24.

FIG. 2 shows the locking mechanism according to the invention in an assembled condition, with the threaded portion 23 of the locking pin engaged within the receiving space 33 of the wedge bar 14, and with the wedge bar 14 and locking pin 12 being received respectively in the vertical slot 41 and longitudinal cylindrical pathway of the cylindrical portion 42 of the bracket 16. The three components are preferably assembled as follows.

The locking pin 12 and wedge bar 14 are manufactured as described above and as shown in FIG. 1. The bracket 16 is also made as described above from a single sheet of metal. Initially, the retaining tabs 45 are not punched into the cylindrical portion 42. The bracket 16 is made so that it is substantially rigid, but with some degree of flexibility, particularly at bends in the metal, based on its modulus of elasticity. The threaded portion 23 is first provided within the receiving space 33 of the wedge bar 14 so that the teeth 35 are accommodated within the groove 24. Then, the locking pin-wedge bar combination is inserted into the bracket 16 through the top of the vertical slot 41 by spreading the first and second mounting tabs 51 and 52 to accommodate the diameter of the locking pin 12. The locking pin-wedge bar combination is inserted until the pin is positioned within the cylindrical portion 42 of the bracket 16, and then the bracket is closed by squeezing the first and second mounting tabs 51 and 52 together until the bracket 16 slidably accommodates both the locking pin 12 and the wedge bar 14 respectively in the cylindrical portion 42 and vertical slot 41 thereof. Once the locking pin 12 is slidably accommodated in the cylindrical portion 42, the retaining tabs 45 are punched into the cylindrical portion 42 adjacent the reduced diameter portion 22 of the locking pin 12 so that the tabs extend and are accommodated within the reduced diameter portion 22 as described above. The bracket 16 is fixed to the casket via conventional means, e.g. via screws through the mounting tabs 51 and 52.

The assembly of FIG. 2 is provided adjacent an outer wall of the casket at an end thereof so that the engagement means located in the head portion 21 of the locking pin 12 is accessible from the outside, e.g. via port through the casket wall. A person or funeral director can then lock and unlock the wedge bar mechanism by rotating the head portion 21 (and therefore the locking pin 12) using an Allen key or other suitable tool as is known in the art.

As will be appreciated, the wedge bar locking mechanism according to the invention is of a simple and reliable design, and is made from only three principal components.

It is noted that the location of the reduced diameter portion 22 in the locking pin 12 is not critical. Though in the described embodiment it is located between the head and threaded portions 21 and 23, alternatively it can be located at any other location along the pin. For example, the reduced diameter portion 22 can be located at the distal end of the locking pin 12 such that the order from proximal to distal of the pin 12 is: head portion 21-threaded portion 23-reduced diameter portion 22; so long as the tabs 45 are correspondingly relocated to be accommodated within the reduced diameter portion 22 of the locking pin 12 in this new location to restrain translational motion of the pin 12.

In addition, though all components of the wedge bar locking mechanism 10 preferably are made from metal, they can be made from other materials, eg., high strength ABS plastic or equivalent material, or other plastic material having physical strength sufficient to withstand the forces to which each component will be subjected during repeated or recurring use. Sheet metal is strongly preferred for the bracket 16 due to the ability to form it via conventional bending techniques.

The disclosed wedge bar locking mechanism is particularly useful for locking a casket, though it is not intended to be limited solely to that application. Other boxes or containers having a closeable lid, as will be evident to those skilled in the art, also can be provided with the wedge bar locking mechanism according to the invention to effect reversible locking and unlocking thereof in a reliable and repeatable manner.

Although the invention has been described with respect to a preferred embodiment, it will be understood that various changes or modifications can be made without deviating from the spirit and scope of the invention as described above and as defined in the appended claims.

What is claimed is:

1. A wedge bar locking mechanism comprising a locking pin, a wedge bar and a bracket, said locking pin comprising a reduced diameter portion and a threaded portion, said threaded portion having a continuous helical groove disposed circumferentially about and extending longitudinally of said threaded portion, said wedge bar comprising first and second longitudinally extending portions at a proximal end thereof, said first and second longitudinally extending portions defining a locking pin receiving space therebetween, at least one of said first and second longitudinally extending portions having at least one tooth extending into said pin receiving space, said tooth being dimensioned to extend into and be accommodated within said helical groove when said threaded portion is received in said pin receiving space, said bracket defining a longitudinally extending slot adapted to accommodate said wedge bar therein, and a longitudinally extending cylindrical portion defining a longitudinal cylindrical pathway adapted to accommodate said locking pin therein, wherein said slot is effective to prevent said wedge bar from rotating as a result of torque supplied to said locking pin when said locking pin and said wedge bar are received, respectively, in said longitudinal cylindrical pathway and said slot.

2. A wedge bar locking mechanism according to claim 1, said bracket further comprising at least one retaining tab extending radially inward of said cylindrical portion into said longitudinal cylindrical pathway of said bracket, said retaining tab being received and accommodated within said reduced diameter portion of said locking pin when said locking pin is received in said longitudinal cylindrical pathway of said bracket.

3. A wedge bar locking mechanism according to claim 2, said retaining tab being formed by punching through a wall of said cylindrical portion such that a punched portion of said wall extends radially inward of the cylindrical portion, still attached to the wall, to provide said retaining tab.

4. A wedge bar locking mechanism according to claim 2, said retaining tab being integral with said bracket.

5. A wedge bar locking mechanism according to claim 2, comprising a plurality of said retaining tabs, each of said plurality of retaining tabs being received and accommodated within said reduced diameter portion of said locking pin when said locking pin is received in said longitudinal cylindrical pathway of said bracket.

6. A wedge bar locking mechanism according to claim 3, comprising a plurality of said retaining tabs formed by punching through said wall of said cylindrical portion, each of said plurality of retaining tabs being received and accommodated within said reduced diameter portion of said locking pin when said locking pin is received in said longitudinal cylindrical pathway of said bracket.

7. A wedge bar locking mechanism according to claim 1, at least one of said first and second longitudinally extending portions having a plurality of said teeth disposed at spaced intervals thereof and extending into said pin receiving space, the spacing of said teeth corresponding to a pitch of said helical groove of said threaded portion of said locking pin.

8. A wedge bar locking mechanism according to claim 1, said threaded portion being in the form of an Acme threaded rod.

9. A wedge bar locking mechanism according to claim 1, said locking pin further comprising means for engagement by a tool or by hand so that the locking pin can be turned to lock or unlock a casket equipped with said locking mechanism.

10. A wedge bar locking mechanism according to claim 9, said engagement means comprising an Allen key receptacle, adapted to receive an Allen key therein.

11. A wedge bar locking mechanism according to claim 9, said engagement means comprising a key receptacle adapted to receive a correspondingly shaped key therein.

12. A wedge bar locking mechanism according to claim 1, said helical groove terminating respectively at proximal and distal hard stops located respectively adjacent either end of the threaded portion.

13. A wedge bar locking mechanism according to claim 1, said cylindrical portion being provided substantially centrally relative to a vertical extent of said slot.

14. A wedge bar locking mechanism according to claim 1, consisting essentially of said locking pin, said wedge bar and said bracket.

15. A wedge bar locking mechanism comprising a locking pin, a wedge bar and a bracket, said locking pin comprising a reduced diameter portion and a threaded portion, said threaded portion having a continuous helical groove disposed circumferentially about and extending longitudinally of said threaded portion, said wedge bar comprising a longitudinally extending portion at a proximal end thereof, said longitudinally extending portion having at least one tooth dimensioned to extend into and be accommodated within said helical groove disposed in said threaded portion of said locking pin, said bracket defining a longitudinally extending slot adapted to accommodate said wedge bar therein, and a longitudinally extending cylindrical portion defining a longitudinal cylindrical pathway adapted to accommodate said locking pin therein.

16. A wedge bar locking mechanism according to claim 15, said bracket further comprising at least one retaining tab extending radially inward of said cylindrical portion into said longitudinal cylindrical pathway of said bracket, said retaining tab being received and accommodated within said reduced diameter portion of said locking pin when said locking pin is received in said longitudinal cylindrical pathway of said bracket.

17. A wedge bar locking mechanism according to claim 16, said retaining tab being formed by punching through a wall of said cylindrical portion such that a punched portion of said wall extends radially inward of the cylindrical portion, still attached to the wall, to provide said retaining tab.

18. A wedge bar locking mechanism according to claim 16, said retaining tab being integral with said bracket.

* * * * *